US008708744B2

(12) United States Patent
Masumoto et al.

(10) Patent No.: US 8,708,744 B2
(45) Date of Patent: Apr. 29, 2014

(54) ELECTRICAL CONNECTOR HAVING SHIELD WITH SOLDERED TERMINAL PORTIONS

(75) Inventors: Toshio Masumoto, Tokyo (JP); Takamitsu Wada, Tokyo (JP); Kenichi Kotaka, Tokyo (JP); Tadahiro Ota, Tokyo (JP)

(73) Assignee: Japan Aviation Electronics Industry, Ltd., Tokyo (JP)

( * ) Notice: Subject to any disclaimer, the term of this patent is extended or adjusted under 35 U.S.C. 154(b) by 176 days.

(21) Appl. No.: 13/521,634

(22) PCT Filed: Nov. 30, 2010

(86) PCT No.: PCT/JP2010/006975

§ 371 (c)(1),
(2), (4) Date: Jul. 11, 2012

(87) PCT Pub. No.: WO2011/114402

PCT Pub. Date: Sep. 22, 2011

(65) Prior Publication Data

US 2013/0017734 A1 Jan. 17, 2013

(30) Foreign Application Priority Data

Mar. 19, 2010 (JP) ..... 2010-064504

(51) Int. Cl.
*H01R 13/648* (2006.01)

(52) U.S. Cl.
USPC ..... 439/607.4

(58) Field of Classification Search
USPC ..... 439/607.35–607.4, 607.54
See application file for complete search history.

(56) References Cited

U.S. PATENT DOCUMENTS

| | | | | |
|---|---|---|---|---|
| 5,013,262 | A * | 5/1991 | Shibano | 439/607.4 |
| 5,094,627 | A * | 3/1992 | Uekido | 439/607.35 |
| 5,288,248 | A * | 2/1994 | Chen | 439/607.19 |
| 5,637,014 | A * | 6/1997 | Sukegawa et al. | 439/607.4 |
| 5,637,015 | A * | 6/1997 | Tan et al. | 439/607.37 |

(Continued)

FOREIGN PATENT DOCUMENTS

| | | |
|---|---|---|
| JP | 2000-357550 | 12/2000 |
| JP | 2004-515890 A | 5/2004 |
| JP | 2007-115707 A | 5/2007 |

OTHER PUBLICATIONS

International Search Report dated Dec. 28, 2010 and English translation thereof, from corresponding International Patent Application No. PCT/JP2010/006975—4 pages.

*Primary Examiner* — Neil Abrams
(74) *Attorney, Agent, or Firm* — Maier & Maier, PLLC

(57) ABSTRACT

A shell of a modular jack includes soldered terminal portions connected to a substrate. The soldered terminal portions include first soldered terminal portions and second soldered terminal portions. The first soldered terminal portions are formed to extend toward the substrate from first side wall portions folded from a front surface of the housing toward a right-side surface and a left-side surface. The second soldered terminal portions are formed to extend toward the substrate from second side wall portions folded from an upper wall portion toward the right-side surface and the left-side surface of the housing, the upper wall portion being folded from the front surface of the housing toward a top surface. The first side wall portions and the second side wall portions cover the right-side surface and the left-side surface of the housing.

5 Claims, 15 Drawing Sheets

(56) References Cited

U.S. PATENT DOCUMENTS

| | | | | |
|---|---|---|---|---|
| 6,203,373 | B1 * | 3/2001 | Lin | 439/607.27 |
| 6,220,895 | B1 * | 4/2001 | Lin | 439/607.01 |
| 6,305,984 | B1 * | 10/2001 | Katoh et al. | 439/607.08 |
| 6,475,033 | B1 * | 11/2002 | Zhu et al. | 439/607.4 |
| 6,682,368 | B2 * | 1/2004 | Murr et al. | 439/607.28 |
| 6,764,338 | B2 * | 7/2004 | Fang | 439/607.2 |
| 6,884,116 | B2 * | 4/2005 | Suzuki et al. | 439/607.32 |
| 7,097,507 | B1 * | 8/2006 | Zhang et al. | 439/607.35 |
| 7,402,080 | B2 * | 7/2008 | Xiao et al. | 439/607.2 |
| 7,645,165 | B2 * | 1/2010 | Wu et al. | 439/607.38 |
| 7,731,534 | B1 * | 6/2010 | Yuan et al. | 439/607.4 |
| 7,744,418 | B2 * | 6/2010 | He et al. | 439/607.35 |
| 7,785,149 | B2 * | 8/2010 | Kamata et al. | 439/607.35 |
| 7,824,220 | B2 * | 11/2010 | Chen | 439/607.35 |
| 7,833,057 | B1 * | 11/2010 | Yang et al. | 439/607.4 |
| 7,887,370 | B2 * | 2/2011 | Chen et al. | 439/607.35 |
| 8,025,532 | B2 * | 9/2011 | Nagata et al. | 439/607.4 |
| 8,070,515 | B2 * | 12/2011 | Nagata et al. | 439/607.13 |
| 8,360,808 | B2 * | 1/2013 | Tsuchiya | 439/607.55 |
| 8,460,034 | B2 * | 6/2013 | Song et al. | 439/607.36 |

* cited by examiner

ELECTRICAL CONNECTOR HAVING SHIELD WITH SOLDERED TERMINAL PORTIONS

RELATED APPLICATIONS

This application is the U.S. national stage application which claims priority under 35 U.S.C. §371 to International Patent Application No.: PCT/JP2010/006975, filed on Nov. 30, 2010, which claims priority under 35 U.S.C. §119 to Japanese Patent Application No. 2010-064504, filed on Mar. 19, 2010, the disclosures of which are incorporated by reference herein their entireties.

TECHNICAL FIELD

The present invention relates to a connector.

BACKGROUND ART

As a technique of this type, Patent Literature 1 discloses a USB (Universal Serial Bus) connector 20 of a so-called right angle type as shown in FIGS. 14 and 15 of this application. This USB connector 20 includes a metal plate shell formed by folding a metal plate. As shown in FIG. 15, this metal plate shell 23 includes a top plate portion 31, right and left side surface plate portions 32 and 33, and a base plate portion 34. A locking piece 36 extending from the base plate portion 34 locks the outer surface of the right-side surface plate portion 33.

CITATION LIST

Patent Literature

Japanese Unexamined Patent Application Publication No. 2000-357550

SUMMARY OF INVENTION

Technical Problem

The connector disclosed in Patent Literature 1 still has room for improvement in suppression of material cost.

It is an object of the present invention to provide a connector that achieves suppression of material cost.

Solution to Problem

According to an aspect of the present invention, there is provided a connector of a right angle type used to be mounted on a substrate, the connector including: a contact; a housing that holds the contact; and a shell that covers the housing. The connector has the following structure. That is, the shell includes a soldered terminal portion connected to the substrate. The soldered terminal portion includes a first soldered terminal portion and a second soldered terminal portion. The first soldered terminal portion is formed to extend toward the substrate from a first side wall portion folded from a front surface of the housing toward a side surface of the housing, the housing having a coupling hole into which a counterpart connector is inserted. The second soldered terminal portion is formed to extend toward the substrate from a second side wall portion folded from an upper wall portion toward the side surface of the housing, the upper wall portion being folded from the front surface of the housing toward a top surface of the housing. The first side wall portion and the second side wall portion cover the side surface of the housing.

The connector described above also has the following structure. That is, the shell includes a front wall portion provided on the front surface of the housing.

The connector described above also has the following structure. That is, the shell includes an abutting portion formed to be able to abut the substrate when a torque that keeps the second side wall portion away from the substrate acts on the housing.

The connector described above also has the following structure. That is, the abutting portion is formed to be folded from the front surface of the housing toward the side surface.

The connector described above has the following structure. That is, the housing is formed to be able to abut the substrate when a torque that keeps the second side wall portion away from the substrate acts on the housing.

The connector described above also has the following structure. That is, the back surface of the housing is formed to be able to abut the substrate when a torque that keeps the second side wall portion away from the substrate acts on the housing.

Advantageous Effects of Invention

According to the present invention, it is possible to provide a connector having no overlapping portion between the first side wall portion including the first soldered terminal portion and the second side wall portion including the second soldered terminal portion, the first side wall portion and the second side wall portion covering the side surface of the housing, thereby achieving suppression of material cost.

DESCRIPTION OF EMBODIMENTS

First Embodiment

Hereinafter, a modular jack according to a first embodiment of the present invention will be described with reference to FIGS. 1 to 11.

Figure 1:
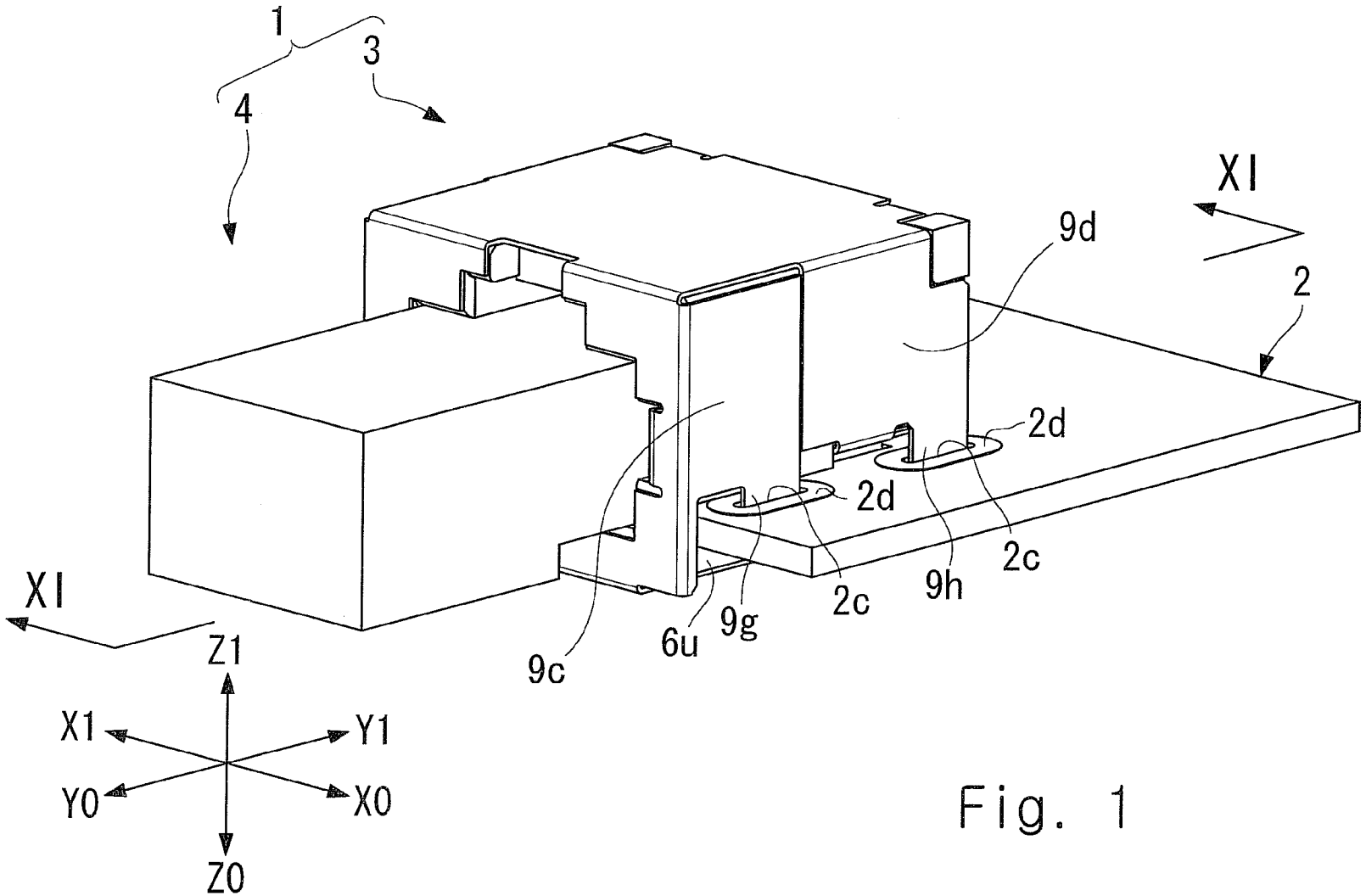
FIG. 1 is a perspective view of a modular connector according to a first embodiment of the present invention.
Figure 2:
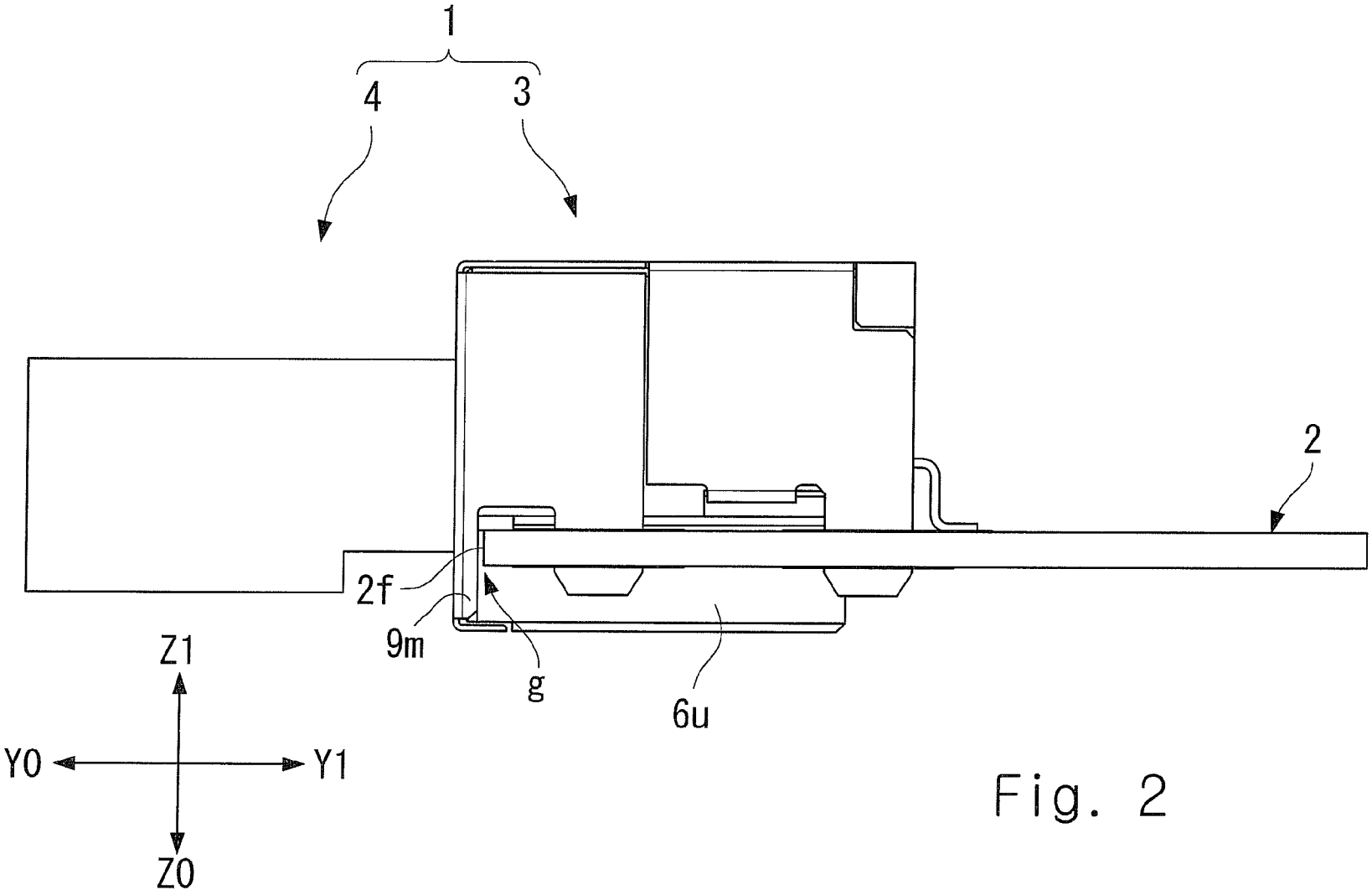
FIG. 2 is a side view of the modular connector according to the first embodiment of the present invention.

First, FIGS. 1 and 2 show a modular connector 1 and a substrate 2. The modular connector 1 connects a cable, such as a LAN (Local Area Network) cable, to the substrate 2, and is composed of a modular jack 3 (connector) which is mounted on the substrate 2, and a modular plug 4 (counterpart connector) which is mounted to the cable. The modular plug 4 is coupled with the modular jack 3, thereby allowing the cable to be connected to the substrate 2.

Figure 3:
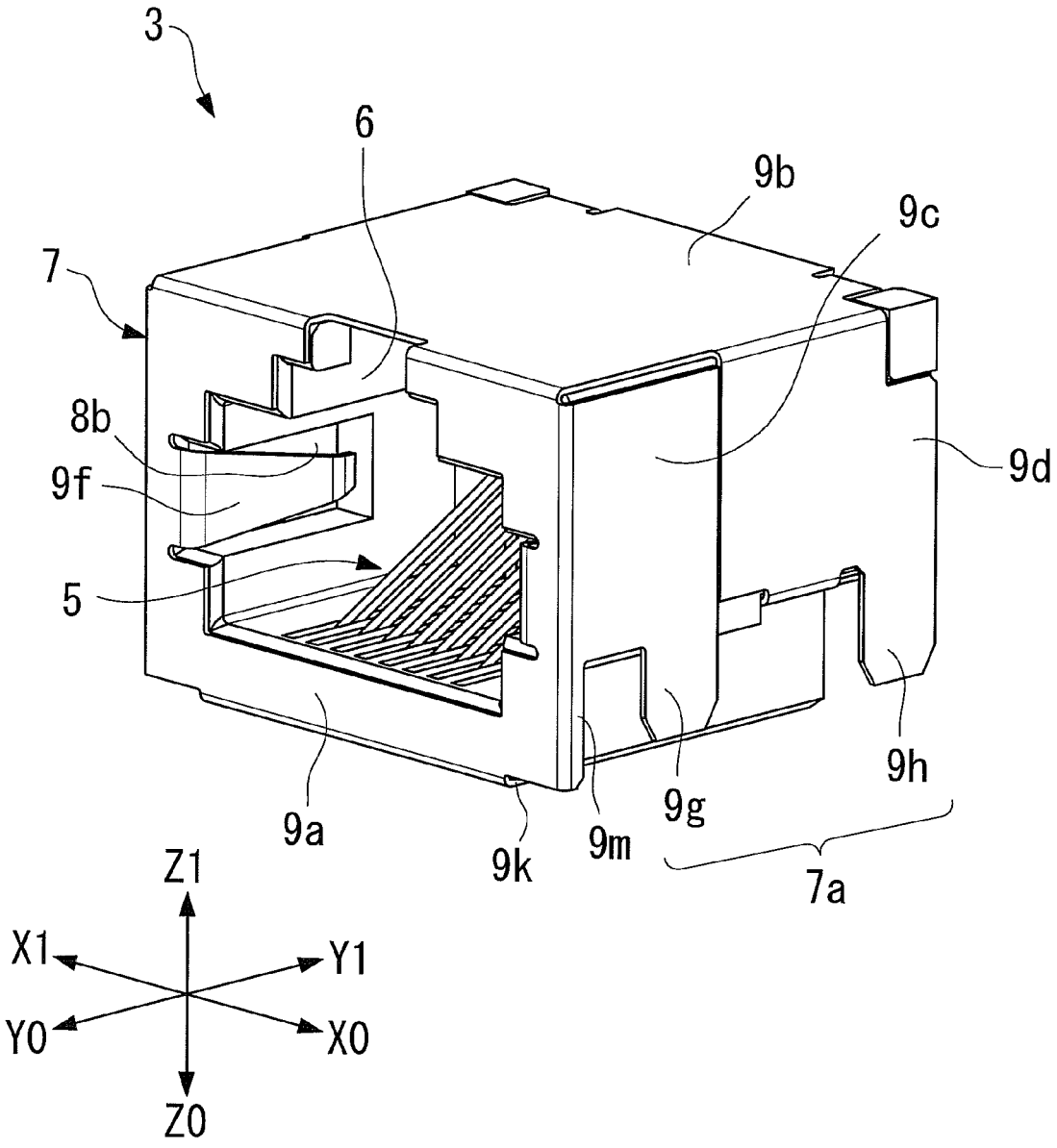
FIG. 3 is a perspective view of the modular jack according to the first embodiment of the present invention when viewed from the front side.
Figure 4:
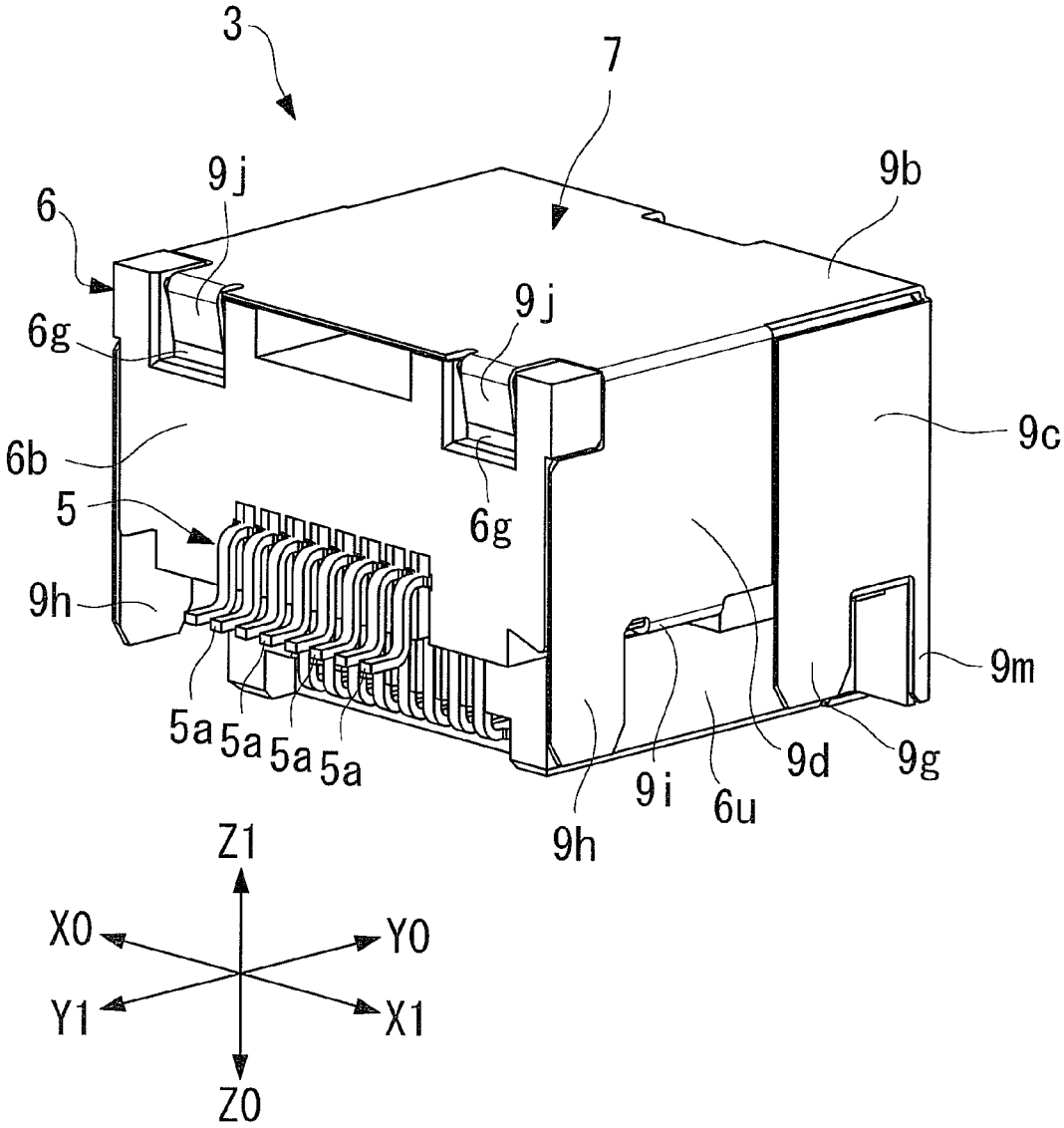
FIG. 4 is a perspective view of the modular jack according to the first embodiment of the present invention when viewed from the back side.

FIGS. 3 and 4 show the modular jack 3 described above. The modular jack 3 includes a plurality of contacts 5, a housing 6 (also see FIG. 5) that holds the plurality of contacts 5, and a shell 7 (also see FIG. 6) that covers the housing 6. As shown in FIGS. 1 and 2, the modular jack 3 is used to be mounted on the substrate 2, and is formed as a right angle type (a type in which a female connector and a male connector are coupled to the substrate is the horizontal direction and a terminal portion to be mounted on the substrate is bent toward the substrate) as shown in the figures.

Herein, for convenience of explanation, as shown in FIG. 1, the direction in which the modular plug 4 is inserted into the modular jack 3 is defined as a direction Y1, and the direction opposite to the direction Y1 is defined as a direction Y0. Similarly, as shown in FIG. 1, the directions which are orthogonal to the directions Y1 and Y0 and parallel with the plane direction of the principal surface of the substrate 2 are defined as directions X0 and X1. Further, as shown in FIG. 1, the directions which are orthogonal to the directions Y1 and Y0 and the directions X0 and X1, that is, the normal line directions of the principal surface of the substrate 2 are defined as directions Z0 and Z1.

Figure 5:
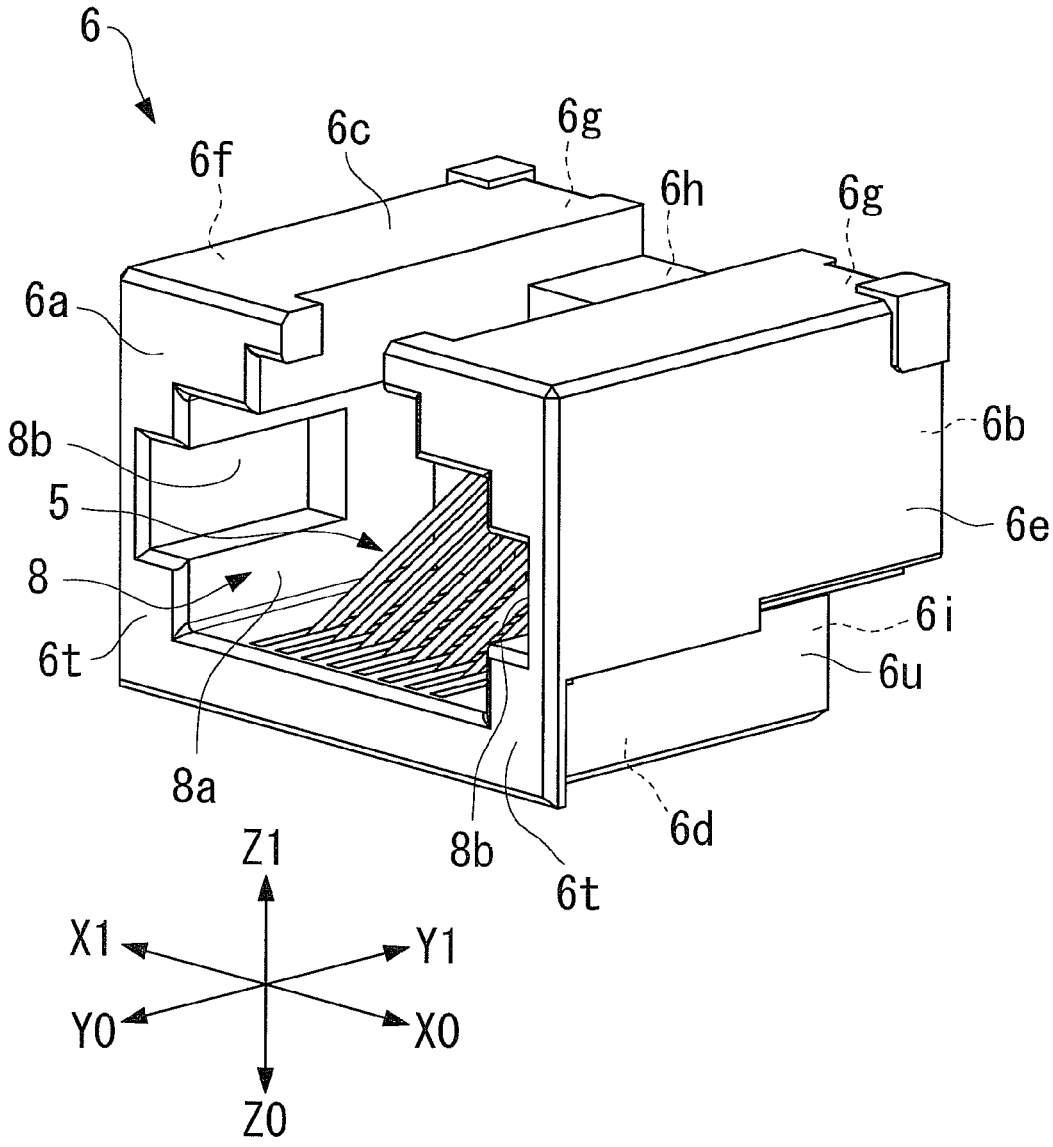
FIG. 5 is a perspective view of a housing that holds a plurality of contacts.

As shown in FIG. 5, the housing 6 has a substantially cubic shape and includes a front surface 6*a*, a back surface 6*b*, a top surface 6*c*, a bottom surface 6*b*, a right-side surface 6*e*, and a left-side surface 6*f*. A coupling chamber 8 (coupling hole) into which the modular plug 4 (also see FIG. 1) can be inserted is formed in the front surface 6*a* of the housing 6. As shown in FIGS. 3 and 4, the plurality of contacts 5 held by the housing 6 is formed to penetrate through the back surface 6*b* from the inside of the coupling chamber 8 and project from the housing 6. Substrate-side edges 5*a* of the contacts 5 shown in FIG. 4 are respectively soldered to electrode pads 2*a* of the substrate 2 shown in FIG. 7. In this regard, it can be said that the modular jack 3 of this embodiment is a surface mount type modular jack.

Figure 6:
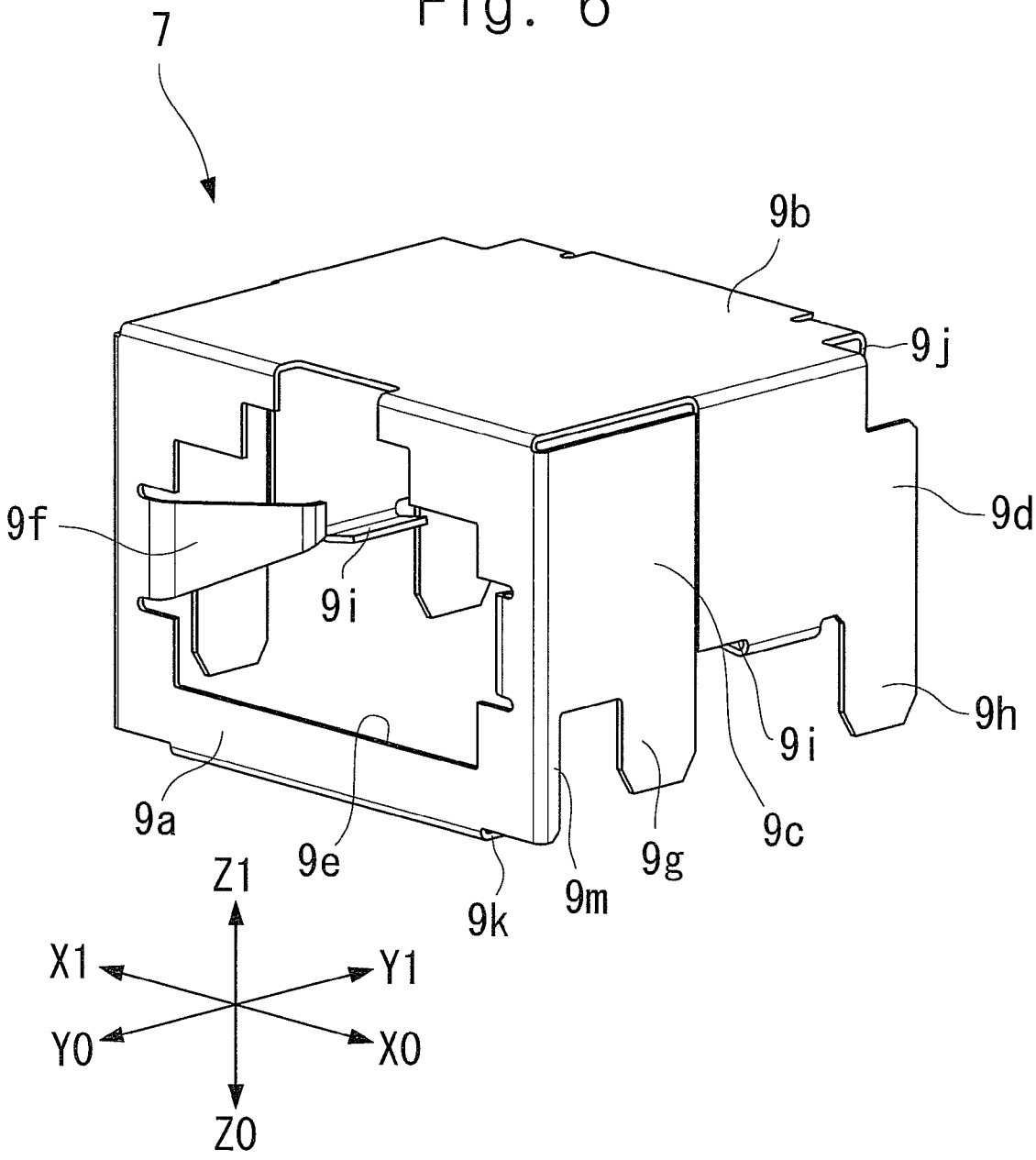
FIG. 6 is a perspective view of a shell.
Figure 8:
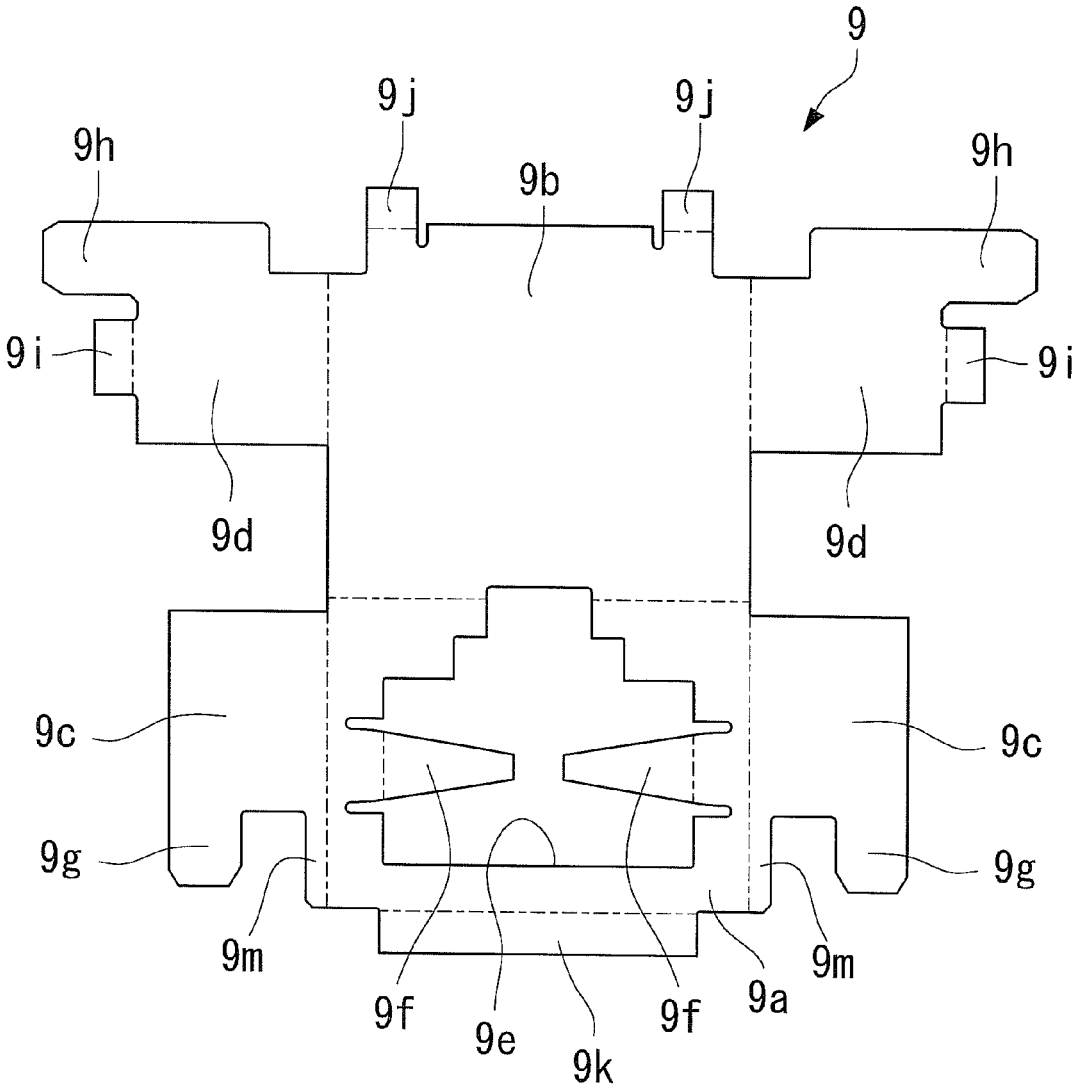
FIG. 8 is a development view of the shell.

The shell 7 shown in FIG. 6 covers the housing 6 as shown in FIGS. 3 and 4 for countermeasures against EMI (Electromagnetic Interference), and is formed by performing a folding process as shown in FIG. 6 on a metal plate 9 shown in FIG. 8.

Figure 7:
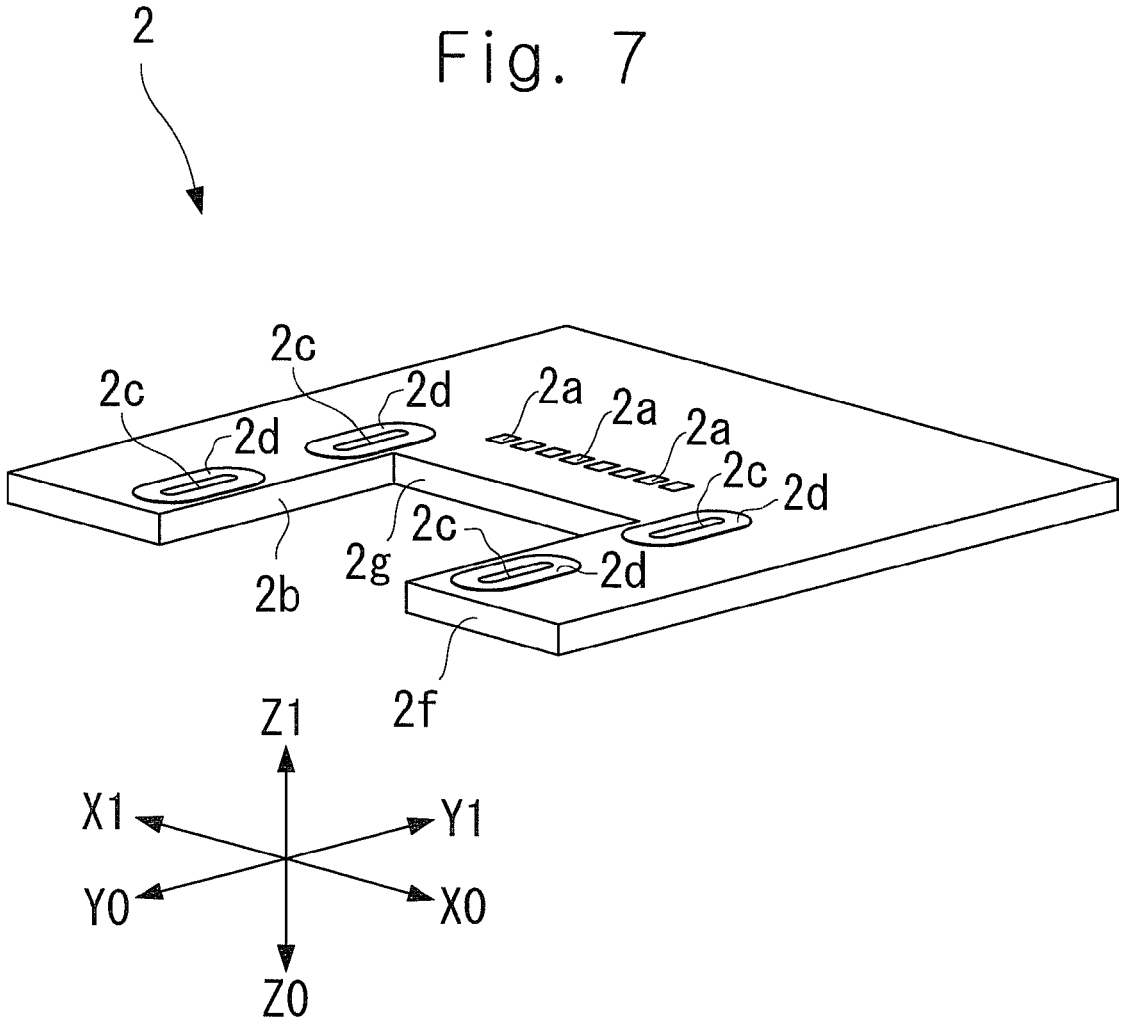
FIG. 7 is a perspective view of a substrate.

As shown in FIGS. 1 and 2, the substrate 2 shown in FIG. 7 includes a notch 2*b* having a substantially rectangular shape in plan view for housing a part of the modular jack 3; fixing holes 2*c* for fixing the modular jack 3 to the substrate 2; and the electrode pads 2*a* described above. As shown in FIG. 7, the plurality of fixing holes 2*c* is formed to sandwich the notch 2*b* in the directions X0 and X1. Specifically, two fixing holes 2*c* are formed on the side of the direction X0 when viewed from the notch 2*b* of the substrate 2, and similarly, two fixing holes 2*c* are formed on the side of the direction X1. Copper foils 2*d* are attached around the respective fixing holes 2*c*.

Next, the housing 6 shown in FIG. 5 and the shell 7 shown in FIG. 6 will be described in more detail.

(Housing 6)

A substrate inserting portion 6*u* having a slightly narrow width is formed at a lower portion of the housing 6. As shown in FIGS. 1 and 2, the substrate inserting portion 6*u* is inserted into the notch 2*b* (also see FIG. 7) of the substrate 2. Further, as shown in FIG. 5, while the substrate inserting portion 6*u* having a narrow width is formed, a pair of flange portions 6*t* is formed at side edges of the front surface 6*a* of the substrate inserting portion 6*u* in order to sufficiently secure the area of the front surface 6*a*.

Contact housing grooves 8*b* are formed in inner wall side surfaces 8*a* of the coupling chamber 8. Further, a pair of fixing grooves 6*g* is formed at an upper end portion of the back surface 6*b* of the housing 6 (also see FIG. 4).

(Shell 7)

As shown in FIG. 8, the metal plate 9 forming the shell 7 is mainly composed of a front wall portion 9*a*, an upper wall portion 9*b*, a pair of first side wall portions 9*c*, and a pair of second side wall portions 9*d*. In FIG. 8, alternate long and short dash lines indicate folded portions.

With cross reference to FIGS. 3, 5, 6, and 8, it can be seen that the front wall portion 9*a* covers the front surface 6*a* of the housing 6. As shown in FIG. 8, the front wall portion 9*a* includes a coupling hole 9*e* corresponding to the outline shape of the coupling chamber 8 (see FIG. 5), and a pair of ground contacts 9*f* for grounding an external shield of the modular plug 4. As shown in FIG. 3, the ground contacts 9*f* are folded to the inside of the coupling chamber 8 and are partially housed in the respective contact housing grooves 8*b*.

With cross reference to FIGS. 3, 5, 6, and 8, it can be seen that the upper wall portion 9*b* is folded at a substantially right angle to the top surface 6*c* from the front surface 6*a* of the housing 6, and covers the top surface 6*c* of the housing 6.

With cross reference to FIGS. 3, 5, 6, and 8, it can be seen that the first side wall portions 9*c* are respectively folded at a substantially right angle to the right-side surface 6*e* and the left-side surface 6*f* from the front surface 6*a* of the housing 6. Similarly, the second side wall portions 9*d* are respectively folded at a substantially right angle to the right-side surface 6*e* and the left-side surface 6*f* from the top surface 6*c* of the housing 6. Further, as shown in FIGS. 3 and 5, the right-side surface 6*e* and the left-side surface 6*f* of the housing 6 are covered by the shell 7 with no gap therebetween due to the presence of the first side wall portions 9*c* and the second side wall portions 9*d*. Specifically, as shown in FIGS. 3, 5, and 6, the first side wall portions 9*c* cover a half portion near the front surface 6*a* of each of the right-side surface 6*e* and the left-side surface 6*f* of the housing 6, and the second side wall portions 9*d* cover a half portion near the back surface 6*b* of each of the right-side surface 6*e* and the left-side surface 6*f* of the housing 6. As shown in FIGS. 3 and 4, the first side wall portions 9*c* and the second side wall portions 9*d* do not overlap each other.

The metal plate 9 shown in FIG. 8 further includes a pair of first soldered terminal portions 9*g* and a pair of second soldered terminal portions 9*h*. The first soldered terminal portions 9*g* are formed to extend downward in the plane of FIG. 8 from the respective first side wall portions 9*c*. That is, as shown in FIG. 1, the first soldered terminal portions 9*g* are formed to extend toward the substrate 2 from the respective first side wall portions 9*c*, and penetrate through the respective fixing holes 2*c*. Further, as shown in FIG. 8, the second soldered terminal portions 9*h* are formed to extend in the horizontal direction in the plane of FIG. 8 from the respective second side wall portions 9*d*. That is, as shown in FIG. 1, the second soldered terminal portions 9*h* are formed to extend toward the substrate 2 from the respective second side wall portions 9*d*, and penetrate through the respective fixing holes 2*c*. In this embodiment, as shown in FIG. 3, each soldered terminal portion 7*a* of the shell 7 is formed of the first soldered terminal portion 9*g* and the second soldered terminal portion 9*h*. As shown in FIG. 1, the first soldered terminal portion 9*g* and the second soldered terminal portion 9*h* are soldered to the substrate 2 through the copper foils 2*d* in the state of being inserted into the respective fixing holes 2*c* of the substrate 2.

As shown in FIG. 8, first claw portions 9*i* are formed in the vicinity of the second soldered terminal portions 9*h*. As shown in FIGS. 4 and 6, each of the first claw portions 9*i* is folded to the inside.

As shown in FIG. 8, a pair of second claw portions 9*j* is formed on the opposite side of the front wall portion 9*a* with the upper wall portion 9*b* interposed therebetween. As shown in FIGS. 4 and 6, each of the second claw portions 9*j* is folded to the inside and housed in the corresponding fixing groove 6*g* (see FIG. 4) of the housing 6.

As shown in FIG. 8, a third claw portion 9*k* is formed on the opposite side of the upper wall portion 9*b* with the front wall portion 9*a* interposed therebetween. The third claw portion 9*k* is folded to the inside as shown in FIGS. 3 and 6.

The first claw portions 9*i*, the second claw portions 9*j*, and the third claw portion 9*k* allow the shell 7 to be fixed to the housing 6, and effectively suppress floating of the shell 7 from the housing 6.

Figure 9:
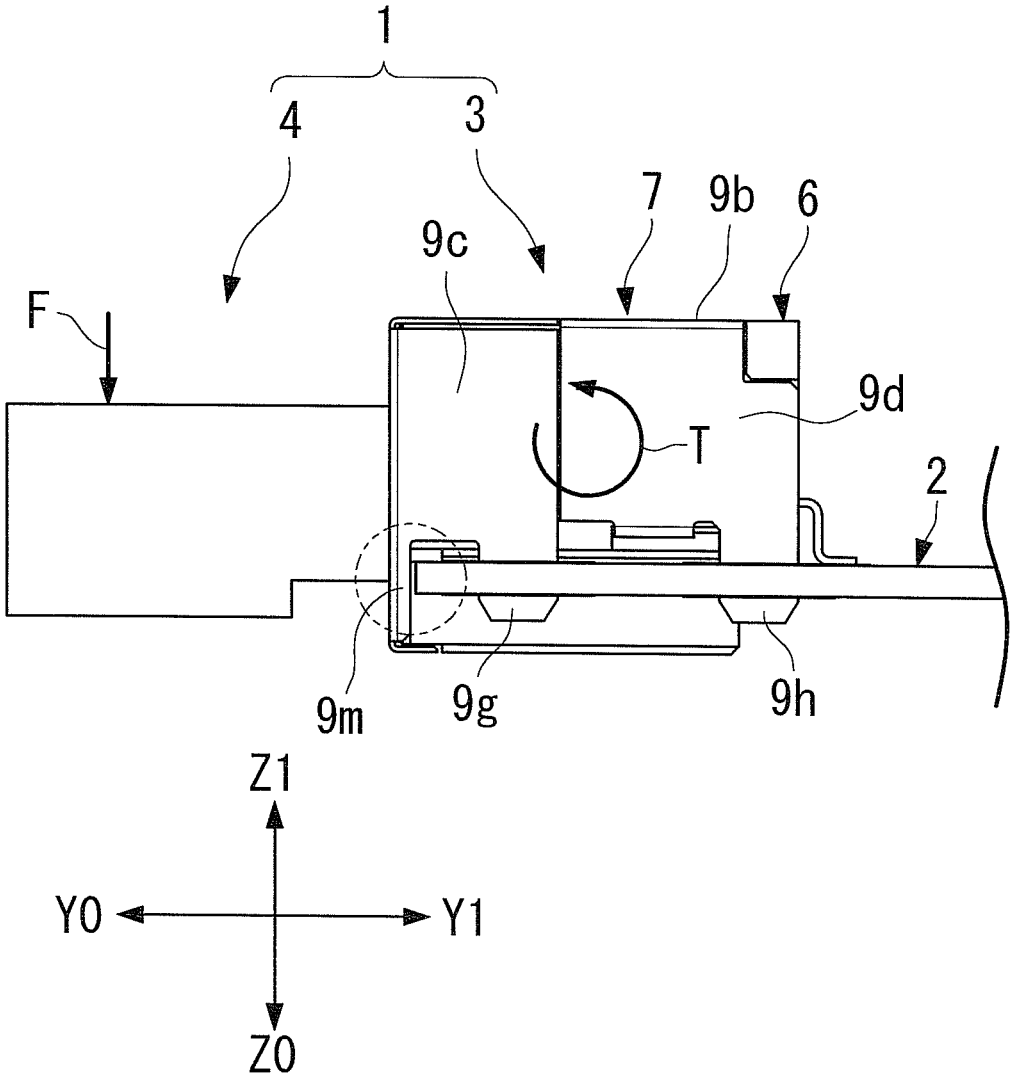
FIG. 9 is a side view of the modular connector according to the first embodiment of the present invention.

As shown in FIG. 8, abutting portions 9*m* are formed in the vicinity of the first side wall portions 9*c*. As with the first side wall portions 9*c*, the abutting portions 9*m* are respectively folded to the right-side surface 6*e* and the left-side surface 6*f* from the front surface 6*a* of the housing 6, as shown in FIGS. 3 and 6. When the modular jack 3 is mounted on the substrate 2 in this structure, a gap g of about 1 mm, for example, is formed between each abutting portion 9*m* and an end face 2*f* of the substrate 2 as shown in FIG. 2. In other words, each of the abutting portions 9*m* is formed in a shape that is extremely close to the end face 2*f* of the substrate 2 when the modular jack 3 is mounted on the substrate 2. The functional roles of the abutting portions 9*m* will be described with reference to FIG. 9 and FIGS. 10A and 10B. Referring first to FIG. 9, assume that the modular plug 4 is pressed and twisted downward in the plane of FIG. 9 with a strong force F. Then, a torque T acting counterclockwise in the plane of FIG. 9 occurs in the modular connector 1. This torque T acts to keep the second side wall portions 9*d* away from the substrate 2. On the other hand, since the second soldered terminal portions 9*h* are soldered to the respective fixing holes 2*c*, the second soldered terminal portions 9*h* act to prevent the second side wall portions 9*d* from being kept away from the substrate 2. Further, since the second soldered terminal portions 9*h* are formed to be folded from the upper wall portion 9*b* through the second side wall portions 9*d*, the strength in the direction in which the upper wall portion 9*b* and the second side wall portions 9*d* are opened when they are pressed with the force F shown in FIG. 9 is strong, which improves the strength of the modular connector 1 with respect to the substrate 2.

Figure 10A:
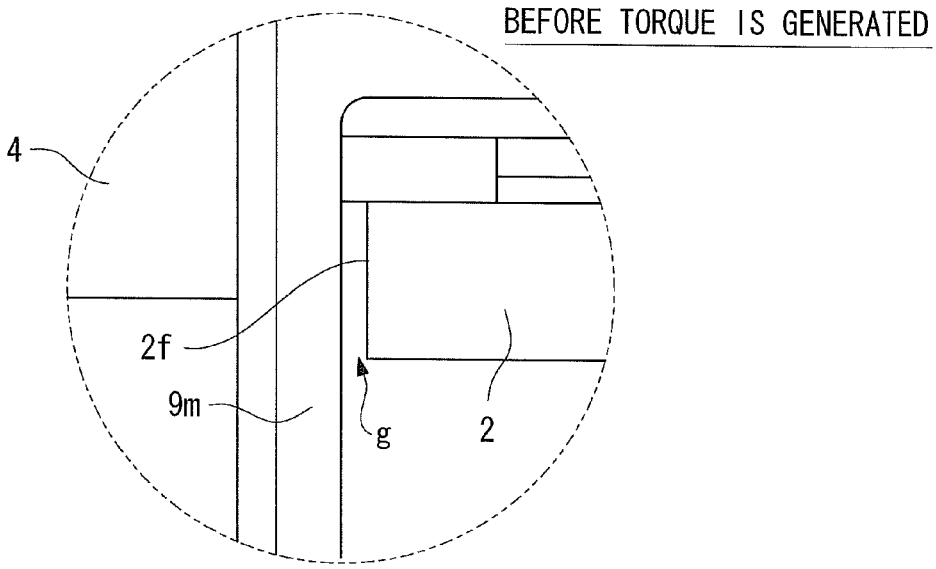
FIG. 10A is a partial enlarged view of FIG. 9.
Figure 10B:
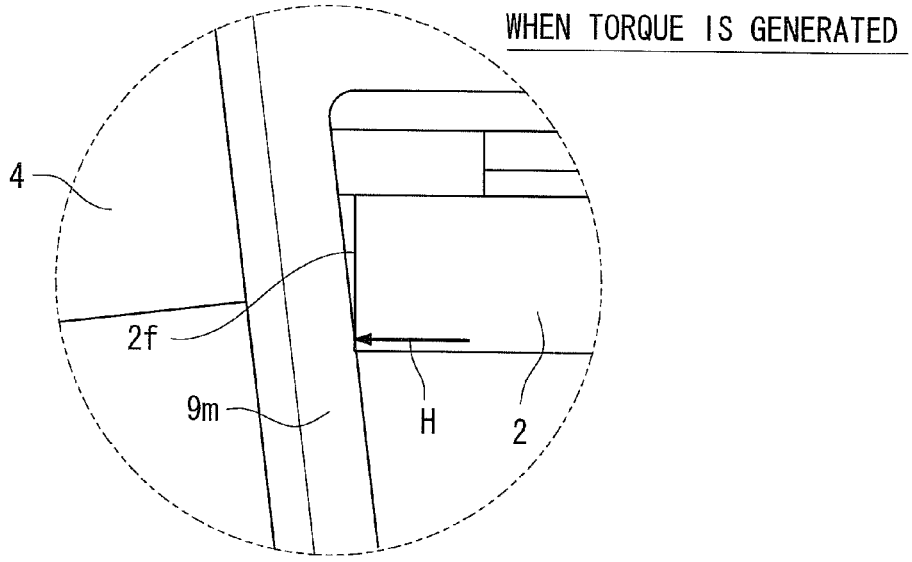
FIG. 10B is a partial enlarged view of FIG. 9.

At this time, the shell 7 shown in FIG. 9 is slightly deformed counterclockwise in the plane of FIG. 9, and the gap g between each abutting portion 9*m* and the end face 2*f* of the substrate 2 shown in FIG. 10A before the generation of the torque disappears as shown in FIG. 10B when the torque is generated. At the same time, the abutting portion 9*m* abuts and contacts the end face 2*f* of the substrate 2. Such a physical contact generates a reaction force H (see FIG. 10B) that is cancelled out by a part of the torque T shown in FIG. 9. Accordingly, the presence of the abutting portions 9*m* enables reduction in the load on the second soldered terminal portions 9*h* when the modular plug 4 is pressed and twisted with the strong force F as shown in FIG. 9.

Figure 11:
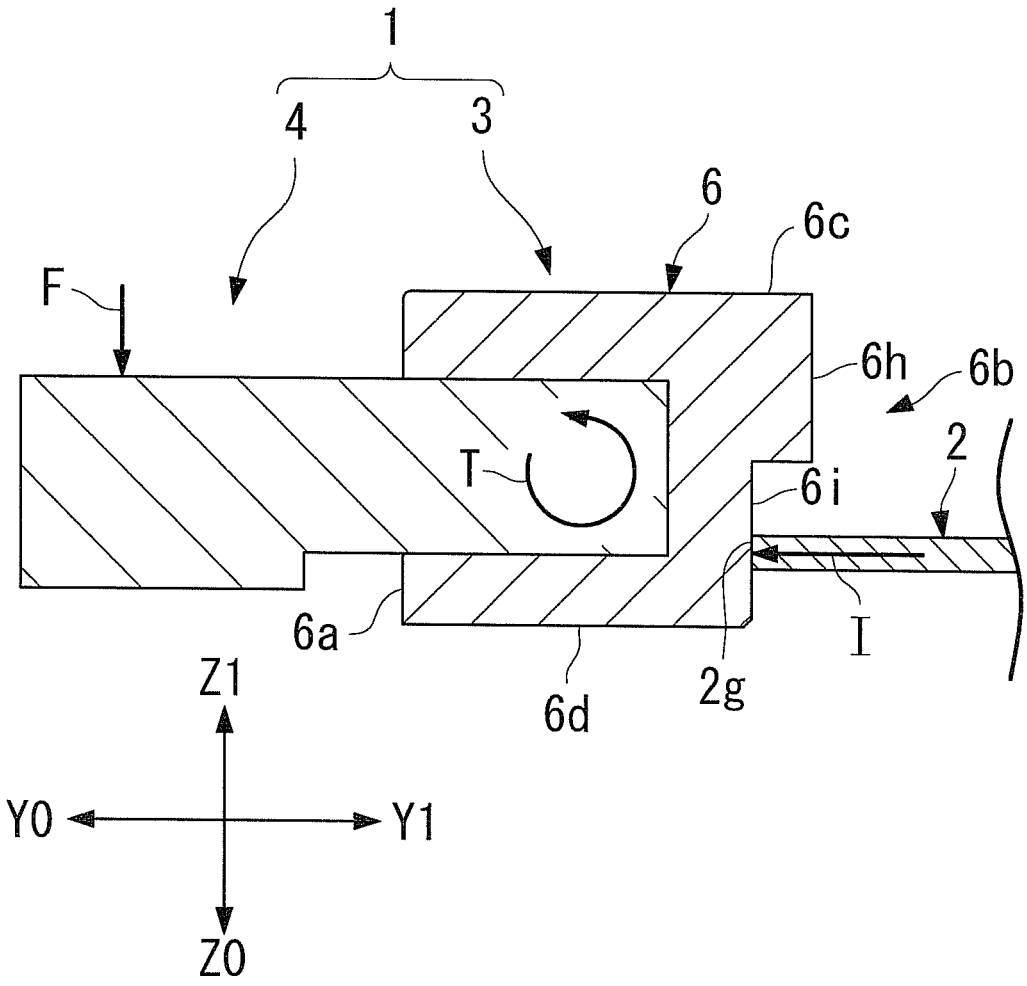
FIG. 11 is a schematic sectional view taken along the line XI-XI- of FIG. 1.

FIG. 11 schematically shows the modular plug 4, the housing 6 of the modular jack 3, and the substrate 2. As shown in FIG. 11, the back surface 6*b* of the housing 6 in this embodiment is formed to be able to abut an end face 2*g* of the substrate 2 when the above-mentioned torque T acts on the housing 6. Specifically, the back surface 6*b* of the housing 6 includes a first back surface 6*h* near the top surface 6*c*, and a second back surface 6*i* near the bottom surface 6*b*. Of these back surfaces, the second back surface 6*i* is formed to contact the end face 2*g* of the substrate 2 in the state of FIG. 11 in which the modular jack 3 is mounted on the substrate 2. Accordingly, when the above-mentioned torque T acts on the housing 6, the second back surface 6*i* of the back surface 6*b* of the housing 6 is allowed to contact the end face 2*g* of the substrate 2 with a strong pressure, so that the second back surface 6*i* receives a reaction force I, which is a reaction force against the contact, from the end face 2*g* of the substrate 2. The reaction force I is cancelled out by a part of the above-mentioned torque T. Accordingly, the presence of the second back surface 6*i* enables reduction in the load on the second soldered terminal portions 9*h* (see FIG. 9) when the modular plug 4 is pressed and twisted with the strong force F as shown in FIG. 11.

Figure 15:
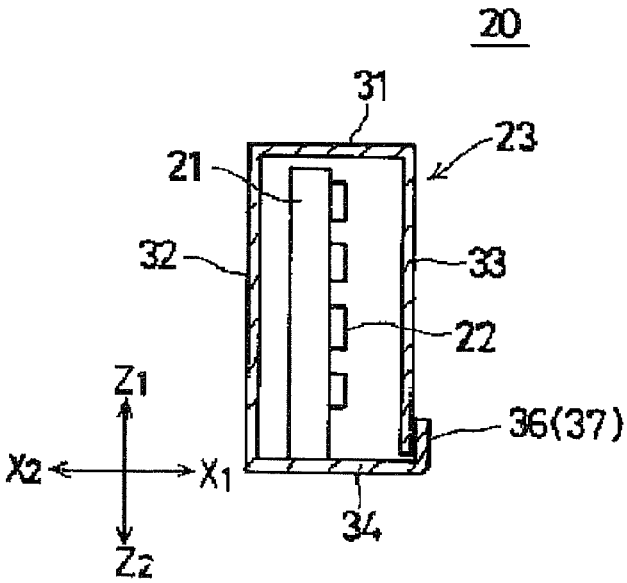
FIG. 15 corresponds to FIG. 3 of Patent Literature 1.

SUMMARY (1) In the embodiments as described above, the modular jack 3 has the following structure. That is, as shown in FIG. 3, the shell 7 includes the soldered terminal portion 7*a* to be connected to the substrate 2. The soldered terminal portion 7*a* includes the first soldered terminal portion 9*g* and the second soldered terminal portion 9*h*. As shown in FIGS. 3 and 5, the first soldered terminal portions 9*g* are formed to extend toward the substrate 2 (see FIG. 1) from the first side wall portions 9*c* which are respectively folded to the right-side surface 6*e* and the left-side surface 6*f* from the front surface 6*a* of the housing 6. As shown in FIGS. 3 and 5, the second soldered terminal portions 9*h* are formed to extend toward the substrate 2 (see FIG. 1) from the second side wall portions 9*d* which are respectively folded to the right-side surface 6*e* and the left-side surface 6*f* of the housing 6 from the upper wall portion 9*b* which is folded to the top surface 6*c* from the front surface 6*a* of the housing 6. Further, as shown in FIGS. 3 and 5, the first side wall portions 9*c* and the second side wall portions 9*d* cover the right-side surface 6*e* and the left-side surface 6*f* of the housing 6. That is, as shown in FIG. 15, as is obvious from the positional relationship between reference numeral 36 (37) and reference numeral 33, the metal plate shell 23 of the USB connector 20 disclosed in Cited Literature 1 has an overlapping portion. On the other hand, according to the structure described above, there is no overlapping portion that overlaps the shell 7 as shown in FIG. 3, thereby suppressing the total area of the metal plate 9 (see FIG. 8) which is the material of the shell 7. Therefore, it is possible to provide the modular jack 3 that achieves suppression of material cost.

As shown in FIG. 1, the modular jack 3 is mounted on the substrate 2 at two positions on one side, thereby achieving strong fixation of the modular jack 3 to the substrate 2.

(2) Further, as shown in FIG. 9 and FIGS. 10A and 10B, the shell 7 includes the abutting portions 9*m* which are formed to be able to abut the substrate 2 when the torque T which keeps the second side wall portions 9*d* away from the substrate 2 acts on the housing 6. Thus, the employment of the structure in which the abutting portions 9*m* are formed to abut the substrate 2 when the torque T is generated allows cancellation of a part of the torque T. Since a part of the torque T is cancelled, the load on the second soldered terminal portions 9*h* which prevents the second side wall portions 9*d* from being kept away from the substrate 2 can be alleviated.

(3) Furthermore, as shown in FIG. 11, the housing 6 is formed to be able to abut the substrate 2 when the torque T which keeps the second side wall portions 9*d* (see FIG. 9) away from the substrate 2 acts on the housing 6. Thus, the employment of the structure in which the housing 6 is formed to be able to abut the substrate 2 when the torque T is generated allows cancellation of a part of the torque T. Since a part of the torque T is cancelled, the load on the second soldered terminal portions 9*h* which prevents the second side wall portions 9*d* from being kept away from the substrate 2 can be alleviated.

Second Embodiment

Figure 12:
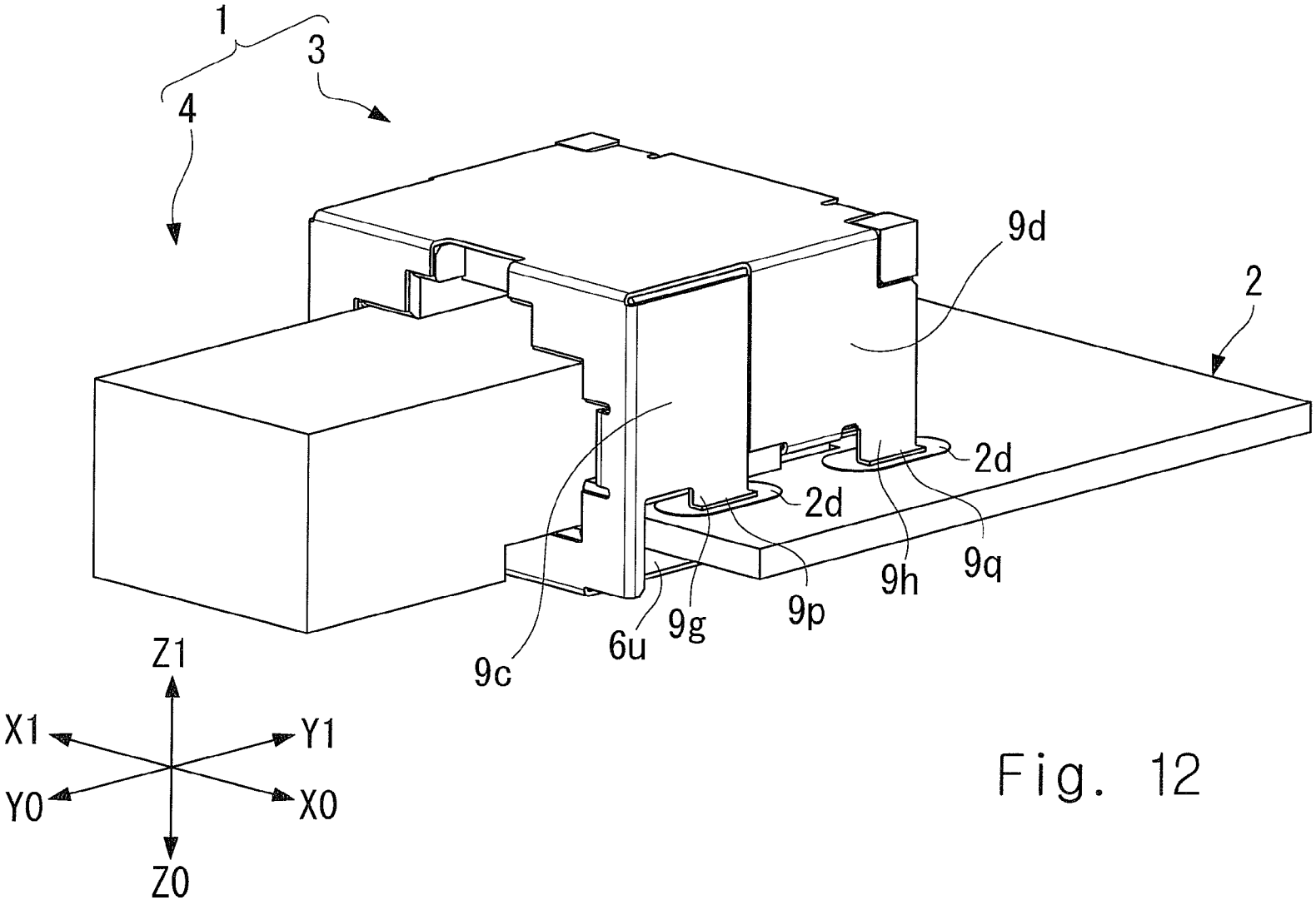
FIG. 12 is a perspective view of a modular connector using a modular jack according to a second embodiment of the present invention.

Referring next to FIG. 12, the modular jack 3 according to a second embodiment of the present invention will be described. Hereinafter, differences between this embodiment and the first embodiment are mainly described, and a repeated explanation is omitted as needed. Further, the components corresponding to those described in the first embodiment are denoted by the same reference numerals as a general rule.

As shown in FIG. 1, in the first embodiment described above, the soldered portions to be soldered to the substrate 2, that is, the first soldered terminal portions 9*g* and the second soldered terminal portions 9*h*, are formed to extend from the first side wall portions 9*c* and the second side wall portions 9*d* so as to penetrate through the respective fixing holes 2*c* of the substrate 2. On the other hand, as shown in FIG. 12, in this embodiment, the fixing holes 2*c* are not formed in the substrate 2. Accordingly, soldered portions 9*p* are formed by folding a lower end portion of each of the first soldered terminal portions 9*g* at a substantially right angle to the outside so as to be in parallel with the substrate 2, and soldered portions 9*q* are formed by folding a lower end portion of each of the second soldered terminal portions 9*h* at a substantially right angle to the outside so as to be in parallel with the substrate 2. The soldered portions 9*p* and the soldered portions 9*q* are soldered to the respective copper foils 2*d* of the substrate 2. Note that the first soldered terminal portions 9*g* and the second soldered terminal portions 9*h* in this embodiment are also formed to extend toward the substrate 2 from the first side wall portions 9*c* and the second side wall portions 9*d*, as with the first embodiment.

Third Embodiment

Figure 13:
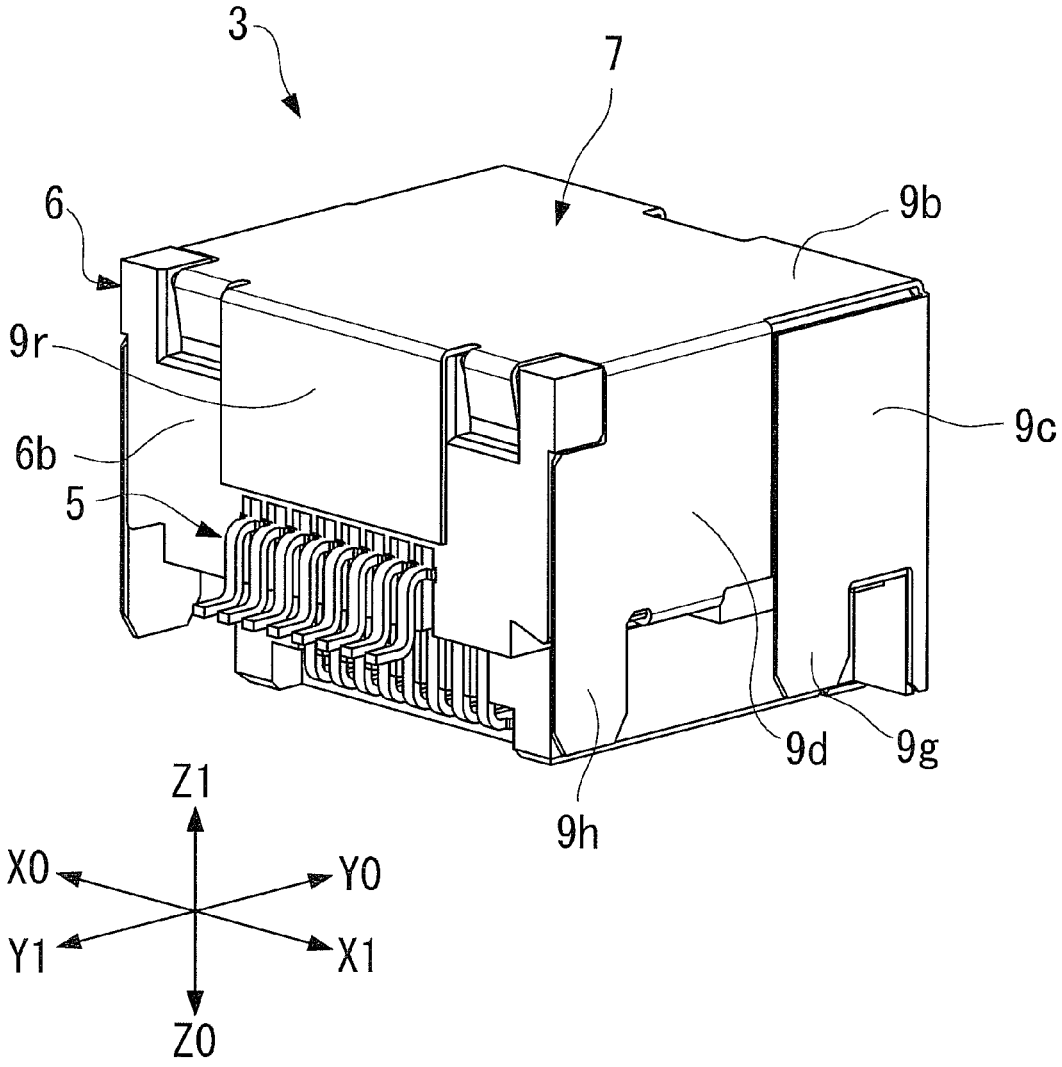
FIG. 13 is a perspective view of a module jack according to a third embodiment of the present invention when viewed from the back side.
Figure 14:
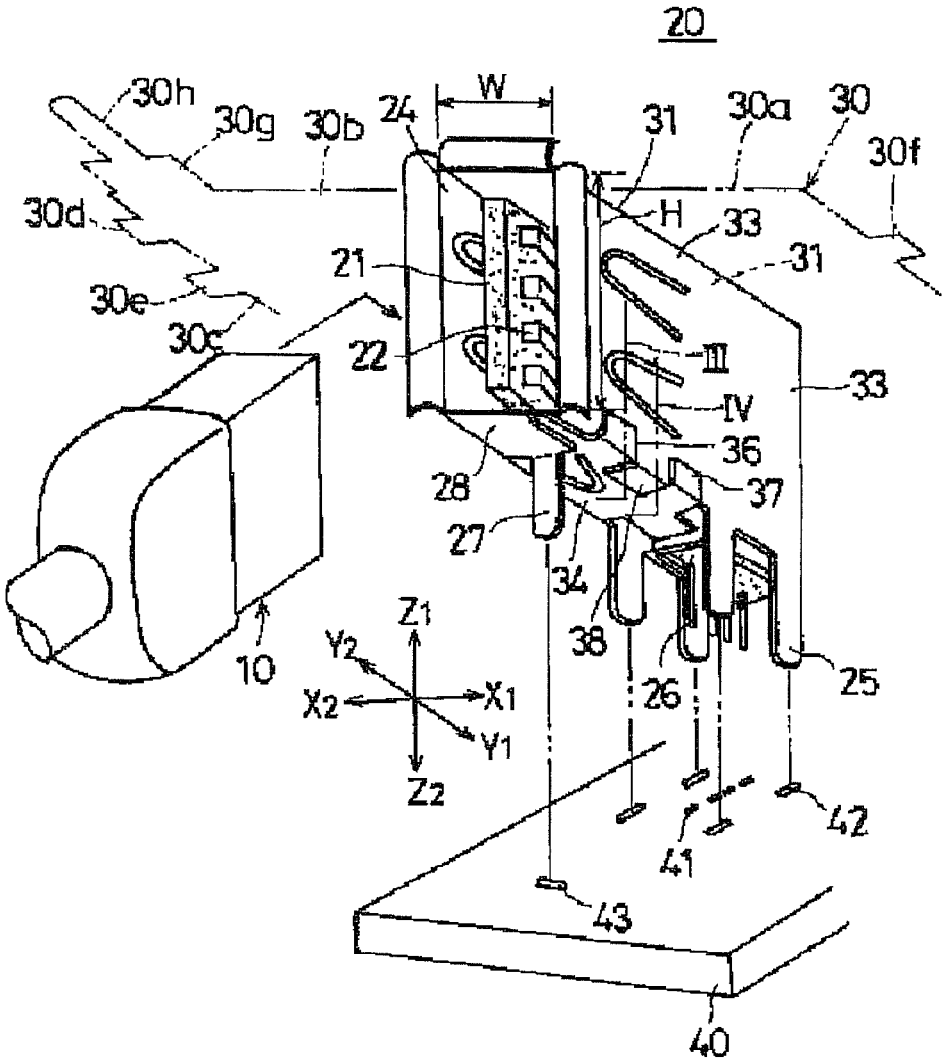
FIG. 14 corresponds to FIG. 2 of Patent Literature 1.

Referring next to FIG. 13, the modular jack 3 according to a third embodiment of the present invention will be described. Hereinafter, differences between this embodiment and the first embodiment are mainly described, and a repeated description is omitted as needed. The components corresponding to those described in the first embodiment are denoted by the same reference numerals as a general rule.

As shown in FIGS. 1 and 3, the shell 7 in this embodiment includes a back wall portion 9*r* which partially covers the back surface 6*b* of the housing 6. This back wall portion 9*r* is formed to be folded toward the back surface 6*b* of the housing 6 shown in FIG. 13 from the top surface 6*c* of the housing 6 shown in FIG. 5. Due to the presence of the back wall portion 9*r*, a wider range of the housing 6 is covered by the shell 7, compared with the first embodiment shown in FIG. 4, thereby enabling the shell 7 to more effectively exert the effect as countermeasures against the EMI.

While preferred embodiments of the present invention have been described above, the embodiments may be appropriately combined with each other.

REFERENCE SIGNS LIST

1 MODULAR CONNECTOR
2 SUBSTRATE
3 MODULAR JACK (CONNECTOR)
4 MODULAR PLUG (COUNTERPART CONNECTOR)
5 CONTACT
6 HOUSING
6*a* FRONT SURFACE
6*b* BACK SURFACE
6*c* TOP SURFACE
6*d* BOTTOM SURFACE
6*e* RIGHT-SIDE SURFACE
6*f* LEFT-SIDE SURFACE
7 SHELL
7*a* SOLDERED TERMINAL PORTION
8 COUPLING CHAMBER
9 METAL PLATE
9*a* FRONT WALL PORTION
9*b* UPPER WALL PORTION
9*c* FIRST SIDE WALL PORTION
9*d* SECOND SIDE WALL PORTION
9*e* COUPLING HOLE
9*f* GROUND CONTACT
9*g* FIRST SOLDERED TERMINAL PORTION
9*h* SECOND SOLDERED TERMINAL PORTION
9*m* ABUTTING PORTION
9*r* BACK WALL PORTION
T TORQUE

The invention claimed is:

1. A connector of a right angle type used to be mounted on a substrate, the connector comprising:

a contact;

a housing that holds the contact; and a shell that covers the housing, wherein the shell includes a soldered terminal portion connected to the substrate, the soldered terminal portion includes a first soldered terminal portion and a second soldered terminal portion, the first soldered terminal portion is formed to extend toward the substrate from a first side wall portion folded from a front surface of the housing toward a side surface of the housing, the housing having a coupling hole into which a counterpart connector is inserted, the second soldered terminal portion is formed to extend toward the substrate from a second side wall portion folded from an upper wall portion toward the side surface of the housing, the upper wall portion being folded from the front surface of the housing toward a top surface of the housing, and the first side wall portion and the second side wall portion cover the side surface of the housing.

2. The connector according to claim 1, wherein the shell includes:

a front wall portion provided on the front surface of the housing; and an abutting portion formed to be able to abut the substrate when a torque that keeps the second side wall portion away from the substrate acts on the housing.

3. The connector according to claim 2, wherein the abutting portion is formed to be folded from the front surface of the housing toward the side surface.

4. The connector according to claim 1, wherein the housing is formed to be able to abut the substrate when a torque that keeps the second side wall portion away from the substrate acts on the housing.

5. The connector according to claim 4, wherein a back surface of the housing is formed to be able to abut the substrate when a torque that keeps the second side wall portion away from the substrate acts on the housing.

* * * * *